US011572732B2

(12) United States Patent
Morosawa et al.

(10) Patent No.: US 11,572,732 B2
(45) **Date of Patent: *Feb. 7, 2023**

(54) VEHICLE CONTROL DEVICE, VEHICLE CONTROL METHOD, AND RECORDING MEDIUM

(71) Applicant: HONDA MOTOR CO., LTD., Tokyo (JP)

(72) Inventors: Ryo Morosawa, Wako (JP); Haisong Liu, Wako (JP); Akira Nakajima, Wako (JP); Kenji Okuma, Wako (JP); Hiroaki Maruyama, Wako (JP); Yoshikazu Matsuo, Wako (JP); Shuto Higashi, Wako (JP); Fumiaki Yamaguchi, Tokyo (JP)

(73) Assignee: HONDA MOTOR CO., LTD., Tokyo (JP)

( * ) Notice: Subject to any disclaimer, the term of this patent is extended or adjusted under 35 U.S.C. 154(b) by 86 days.

This patent is subject to a terminal disclaimer.

(21) Appl. No.: 17/197,783

(22) Filed: Mar. 10, 2021

(65) Prior Publication Data

US 2021/0293074 A1 Sep. 23, 2021

(30) Foreign Application Priority Data

Mar. 18, 2020 (JP) ..... JP2020-048071

(51) Int. Cl.
*E05F 15/00* (2015.01)
*E05F 15/73* (2015.01)

(52) U.S. Cl.
CPC ..... *E05F 15/73* (2015.01); *E05F 2015/767* (2015.01); *E05Y 2400/45* (2013.01); *E05Y 2400/86* (2013.01); *E05Y 2900/531* (2013.01)

(58) Field of Classification Search
CPC ..... E05F 15/73; E05F 2015/767; E05Y 2400/525; E05Y 2800/426; E05Y 2900/531; E05Y 2400/45; E05Y 2400/86
USPC ..... 49/31
See application file for complete search history.

(56) References Cited

U.S. PATENT DOCUMENTS

2009/0033256 A1* 2/2009 Kamiya ..... B60J 5/06 49/31
2016/0026191 A1* 1/2016 Fujimoto ..... E05F 15/73 701/49
2016/0139579 A1* 5/2016 Hirota ..... H03K 17/9622 700/275
2017/0113652 A1* 4/2017 Tokudome ..... B60R 25/2036
2017/0232932 A1* 8/2017 Nishidai ..... B60R 25/2054 340/5.61
2018/0283081 A1* 10/2018 Tamura ..... E05F 15/76
(Continued)

FOREIGN PATENT DOCUMENTS

JP 2003-138817 5/2003

*Primary Examiner* — Chi Q Nguyen
(74) *Attorney, Agent, or Firm* — Rankin, Hill & Clark LLP

(57) ABSTRACT

A vehicle control device includes a power door control unit that executes first power-door-opening control for causing a power door to perform an opening operation, when the power door is in a closed state and a vehicle-interior-situation recognizing unit recognizes a first user who uses a predetermined seat provided in a vehicle, and when a vehicle-surrounding-situation recognizing unit recognizes that a second user who has got off the vehicle approaches the power door corresponding to the predetermined seat.

9 Claims, 13 Drawing Sheets

(56) References Cited

U.S. PATENT DOCUMENTS

| | | | | |
|---|---|---|---|---|
| 2020/0087965 | A1* | 3/2020 | Battlogg | E05F 5/00 |
| 2020/0173218 | A1* | 6/2020 | Kim | B60J 5/047 |
| 2021/0213957 | A1* | 7/2021 | Brown | G01C 21/3438 |
| 2021/0263591 | A1* | 8/2021 | Bensalem | E05F 15/665 |
| 2022/0074242 | A1* | 3/2022 | Kim | E05B 83/36 |
| 2022/0194318 | A1* | 6/2022 | Nishikawa | B60R 25/32 |
| 2022/0213722 | A1* | 7/2022 | Linden | E05B 85/10 |

* cited by examiner

VEHICLE CONTROL DEVICE, VEHICLE CONTROL METHOD, AND RECORDING MEDIUM

INCORPORATION BY REFERENCE

The present application claims priority under 35 U.S.C. § 119 to Japanese Patent Application No. 2020-048071 filed on Mar. 18, 2020. The content of the application is incorporated herein by reference in its entirety.

BACKGROUND OF THE INVENTION

Field of the Invention

The present invention relates to a vehicle control device, a vehicle control method, and a recording medium.

Description of the Related Art

Conventionally, there has been known an entry system that permits entry to a vehicle by personal authentication for a target person approaching the vehicle, using an image of surroundings of the vehicle taken by a camera (see, for example, Japanese Patent Laid-Open No. 2003-138817). The entry system identifies whether the target person is a user depending on the degree of agreement between the iris data of the target person recognized from the image of the target person approaching the vehicle and the iris data of the user registered in advance.

In recent years, vehicles provided with a power door that performs an opening and closing operation by an actuator have been widespread. In such a vehicle, in addition to authenticating a user to permit entry to the vehicle as in conventional systems, it is desired to cause the power door to perform an opening operation at an appropriate timing according to a usage status of the vehicle.

The present invention has been made with respect to such a background, and an object of the present invention is to provide a vehicle control device, a vehicle control method, and a recording medium capable of causing a power door of a vehicle to perform an opening operation at an appropriate timing according to a usage status of the vehicle.

SUMMARY OF THE INVENTION

As a first aspect for achieving the object, there is provided a vehicle control device that controls an opening operation of a power door provided in a vehicle, the vehicle control device including: a vehicle-surrounding-situation recognizing unit that recognizes a surrounding situation of the vehicle; a vehicle-interior-situation recognizing unit that recognizes a situation of an interior of the vehicle; and a power door control unit that executes first power-door-opening control, when the power door is in a closed state and the vehicle-interior-situation recognizing unit recognizes a first user who uses a predetermined seat provided in the vehicle, and when the vehicle-surrounding-situation recognizing unit recognizes that a second user approaches the power door corresponding to the predetermined seat, the first power-door-opening control causing the power door to perform the opening operation, the second user being a user who has got off the vehicle.

The vehicle control device may be configured such that the power door control unit executes the first power-door-opening control when the vehicle-interior-situation recognizing unit recognizes that the first user uses an infant safety seat, the infant safety seat being attached to the predetermined seat.

The vehicle control device may be configured such that the power door control unit prohibits the first power-door-opening control when the vehicle-interior-situation recognizing unit recognizes a third user who is in a vicinity of the first user in the vehicle.

The vehicle control device may be configured such that: the predetermined seat is a seat at one end of a predetermined row of the vehicle; and the power door control unit executes second power-door-opening control when the vehicle-interior-situation recognizing unit recognizes that a fourth user has picked up the first user, the second power-door-opening control causing the power door corresponding to a seat at another end of the predetermined row to perform the opening operation.

The vehicle control device may be configured such that the power door control unit prohibits the first power-door-opening control when the vehicle-surrounding-situation recognizing unit recognizes that both hands of the second user are full.

The vehicle control device may be configured such that: the power door is a power hinge door; and the power door control unit executes the first power-door-opening control when the vehicle-surrounding-situation recognizing unit recognizes that: the second user is outside a movable range of the power hinge door; and the second user is located at a position where the second user faces a range, the range being between an opening of the power hinge door and an inner surface of the power hinge door when the power hinge door performs the opening operation.

The vehicle control device may be configured such that: the power door is a power slide door; and the power door control unit executes the first power-door-opening control when the vehicle-surrounding-situation recognizing unit recognizes that the second user is located at a position facing the power door.

As a second aspect for achieving the above object, there is provided a vehicle control method executed by a computer to control an opening operation of a power door provided in a vehicle, the method including: a vehicle-surrounding-situation recognizing step that recognizes a surrounding situation of the vehicle; a vehicle-interior-situation recognizing step that recognizes a situation of an interior of the vehicle; and a power door control step that executes first power-door-opening control, when the power door is in a closed state and the vehicle-interior-situation recognizing step recognizes a first user who uses a predetermined seat provided in the vehicle, and when the vehicle-surrounding-situation recognizing step recognizes that a second user approaches the power door corresponding to the predetermined seat, the first power-door-opening control causing the power door to perform the opening operation, the second user being a user who has got off the vehicle.

As a third aspect for achieving the above object, there is provided a non-transient recording medium on which a vehicle control program is recorded, the program causing a computer, to control an opening operation of a power door provided in a vehicle, to function as: a vehicle-surrounding-situation recognizing unit that recognizes a surrounding situation of the vehicle; a vehicle-interior-situation recognizing unit that recognizes a situation of an interior of the vehicle; and a power door control unit that executes first power-door-opening control, when the power door is in closed state and the vehicle-interior-situation recognizing unit recognizes a first user who uses a predetermined seat provided in the vehicle, and when the vehicle-surrounding-situation recognizing unit recognizes that a second user approaches the power door corresponding to the predetermined seat, the first power-door-opening control causing the power door to perform the opening operation, the second user being a user who has got off the vehicle.

According to the above vehicle control device, when a predetermined seat of the vehicle is used by a first user who needs assistance when getting off, such as an infant or an elderly person, and when the second user who has got off the vehicle approaches the power door corresponding to the predetermined seat, the power door control unit executes the first power-door-opening control to cause the power door to perform the opening operation. The second user can get on the vehicle from the power door that has finished the opening operation, to assist the first user in getting off the vehicle, without an operation for causing the power door to perform the opening operation.

As described above, the vehicle control device can appropriately cause the power door of the vehicle to perform the opening operation in response to the usage status of the vehicle in which a user who needs assistance when getting off is on the vehicle.

DETAILED DESCRIPTION OF THE PREFERRED EMBODIMENTS

1. Vehicle Configuration

A configuration of a vehicle 1 equipped with a vehicle control device 10 of this embodiment is described below with reference to FIG. 1. The vehicle control device 10 authenticates a user Ud who carries a portable key 200 of the vehicle 1, with the portable key 200, to permit the use of the vehicle 1.

Figure 1:
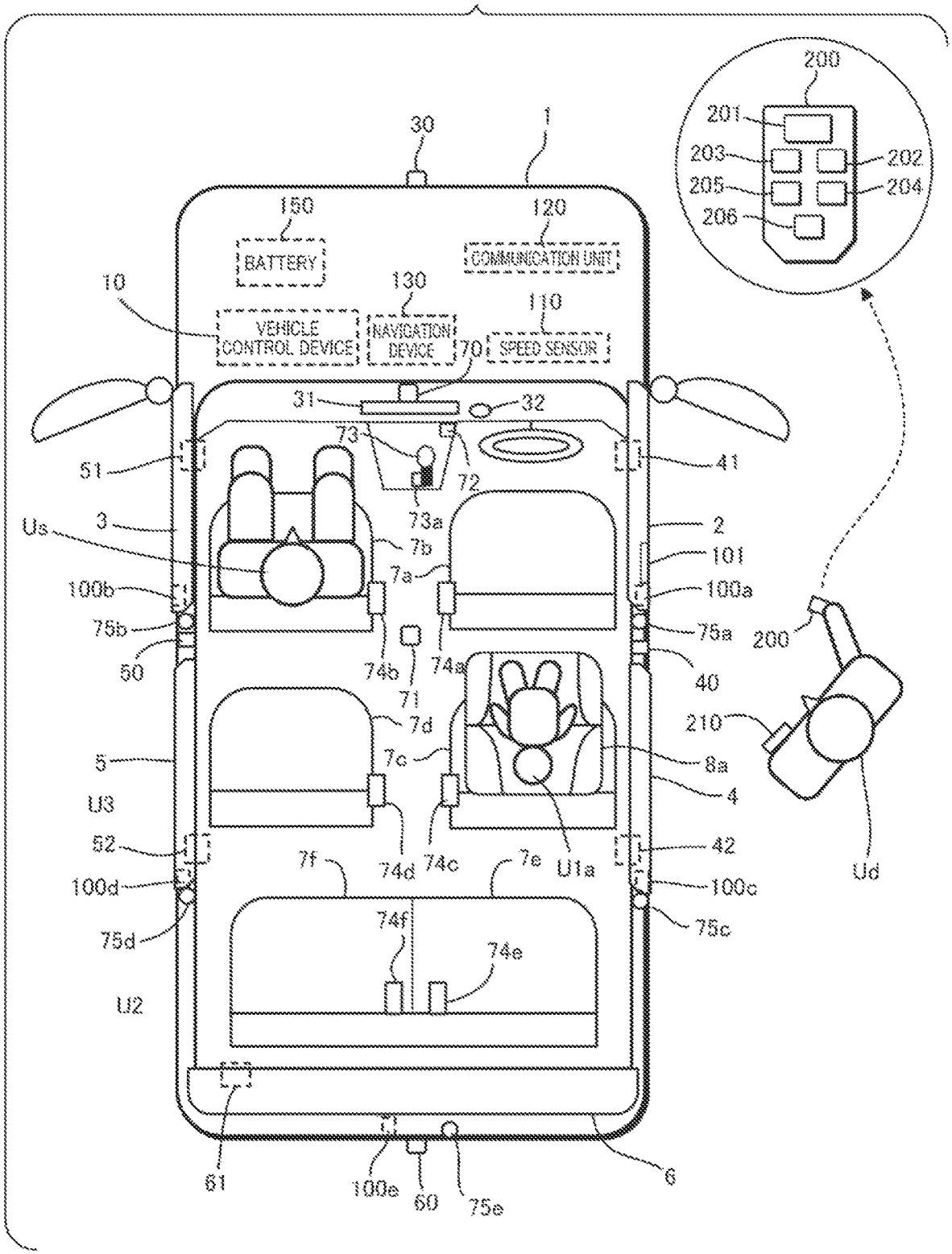
FIG. 1 is a configuration diagram of a vehicle equipped with a vehicle control device.

As shown in FIG. 1, the vehicle 1 is a passenger car having a seating capacity of six people, and includes a driver's seat 7*a*, a front passenger seat 7*b*, a second row right seat 7*c*, a second row left seat 7*d*, and a third row right seat 7*e*, and a third row left seat 7*f*. The respective seats 7*a* to 7*f* are provided with seatbelt switches 74*a* to 74*f* (not shown) for detecting whether respective seatbelts are fastened. In the following, the second row right seat 7*c* and the second row left seat 7*d* are also collectively referred to as second row seats, and the third row right seat 7*e* and the third row left seat 7*f* are also collectively referred to as third row seats.

The vehicle 1 includes a right power hinge door 2, a left power hinge door 3, a right power slide door 4, a left power slide door 5, and a power tailgate 6. Hereinafter, the right power hinge door 2, the left power hinge door 3, the right power slide door 4, and the left power slide door 5 are also referred to as power doors. The right power slide door 4 and the left power slide door 5 are power doors corresponding to the second row seats and the third row seats.

The door knob of the right power hinge door 2 is provided with a door touch sensor 101, and the user Ud who carries the portable key 200 of the vehicle 1 can unlock the doors 2 to 6 of the vehicle 1 by touching the door touch sensor 101.

The right power hinge door 2 includes a right PHD (Power Hing Door) drive unit 41 that drives the right power hinge door 2 by an electric actuator (not shown) for opening and closing, and the left power hinge door 3 includes a left PHD drive unit 51 that drives the left power hinge door 3 by an electric actuator for opening and closing. The right power slide door 4 includes a right PSD (Power Slide Door) drive unit 42 that drives the right power slide door 4 by an electric actuator for opening and closing, and the left power slide door 5 includes a left PSD drive unit 52 that drives the left power slide door 5 by an electric actuator for opening and closing. The power tailgate 6 includes a PTG (Power Tail Gate) drive unit 61 that drives the power tailgate 6 by an electric actuator for opening and closing.

A user Us sits on the front passenger seat 7*b*. In addition, a child safety seat 8*a* (corresponding to an infant safety seat of the present invention) is attached to the second row right seat 7*c*, and a user U1*a* uses the child safety seat 8*a*. The vehicle control device 10 executes power-door-opening control that automatically causes the power door to perform an opening operation in order to facilitate assistance when the user U1*a* gets off. The power-door-opening control is to be described below in detail.

A front camera 30 for photographing the front of the vehicle 1 is provided at a front part of the vehicle 1, and a rear camera 60 for photographing the rear of the vehicle 1 is provided at a rear part of the vehicle 1. A right side camera 40 for photographing the right side of the vehicle 1 is provided on a right side part of the vehicle 1, and a left side camera 50 for photographing the left side of the vehicle 1 is provided on a left side part of the vehicle 1.

The dashboard of the vehicle interior is provided with a front-seat camera 70 for photographing users who sit on the driver's seat 7*a* and the front passenger seat 7*b*, a display 31, and a speaker 32. On the ceiling of the vehicle interior, there is provided a rear-seat camera 71 that photographs the users seated in the second row right seat 7*c*, the second row left seat 7*d*, the third row right seat 7*e*, and the third row left seat 7*f*.

The respective doors 2 to 5 are provided with door switches 75*a* to 75*d* for detecting the opening and closing of the doors. The power tailgate 6 is also provided with a door switch 75*e* for detecting the opening and closing of the power tailgate 6. Furthermore, a power switch 72 for instructing on and off of a battery 150 and a shift switch 73*a* for detecting a shift position of a shift lever 73 are provided near the driver's seat 7*a*. When the battery 150 is in an on state, electric power is supplied from the battery 150 to a load 151 (see FIG. 2), and when the battery 150 is in an off state, supply of electric power from the battery 150 to the load 151 is shut off. The load 151 includes an air conditioner (not shown) and an electric motor, provided in the vehicle 1.

Furthermore, the vehicle 1 includes: door lock mechanisms 100*a* to 100*e* for locking the respective doors 2 to 5 and the power tailgate 6; a speed sensor 110 for detecting a traveling speed of the vehicle 1; a communication unit 120 for communicating with the portable key 200, a user terminal 210 used by the user Ud, and the like; and a navigation device 130. The navigation device 130 has a GPS (Global Positioning System) sensor and map data (not shown), and executes route guidance to a destination based on the position of the vehicle 1 detected by the GPS sensor and the map data.

2. Vehicle Control Device Configuration

A configuration of the vehicle control device 10 is described below with reference to FIG. 2. The vehicle control device 10 is an ECU (Electronic Control Unit) that is configured with a CPU (Central Processing Unit, which corresponds to a computer of the present invention and is not shown), a memory 80, an interface circuit (not shown), and the like, to control an operation of the vehicle 1.

The vehicle control device 10 receives input of images of the surroundings of the vehicle 1 taken by the front camera 30, the right side camera 40, the left side camera 50, and the rear camera 60. In addition, the vehicle control device 10 receives input of images of the vehicle interior taken by the front-seat camera 70 and the rear-seat camera 71.

Furthermore, the vehicle control device 10 receives input of: detection signals of the power switch 72, the shift switch 73*a*, the seatbelt switches 74*a* to 74*f*, and the door switches 75*a* to 75*e*; and lock detection signals for the respective doors 2 to 5 and the power tailgate 6 by door lock sensors (not shown) provided in the door lock mechanisms 100*a* to 100*e*.

In addition, the vehicle control device 10 receives input of: a touch detection signal by the door touch sensor 101; a speed detection signal of the speed sensor 110; and information on the current position of the vehicle 1 detected by the navigation device 130.

Control signals output from the vehicle control device 10 control the operation of: the right PHD drive unit 41; the right PSD drive unit 42; the left PHD drive unit 51; the left PSD drive unit 52; the PTG drive unit 61; the door lock mechanisms 100*a*-100*e*; and the battery 150. In addition, the control signals output from the vehicle control device 10 control screen display of the display 31, and the sound (voice guidance, chime sound, and so on) output from the speaker 32. The vehicle control device 10 communicates with the portable key 200 carried by the user Ud and the user terminal 210 (see FIG. 1) used by the user Ud, via the communication unit 120.

The CPU reads and executes a control program 81 of the vehicle control device 10 stored in the memory 80 to function as: a key authentication unit 11, a vehicle-surrounding-situation recognizing unit 12, a vehicle-interior-situation recognizing unit 13, and a power door control unit 14. The control program 81 includes a vehicle control program of the present invention. The memory 80 stores an authentication ID code 82 used when the user is authenticated by the portable key 200. The CPU corresponds to a computer. The memory 80 corresponds to a recording medium. The control program 81 may be recorded on an external recording medium (flash memory, magnetic disk, optical disk, etc.) that can be read and written by a computer, to be transferred from the external recording medium to the memory 80. The memory 80 and the external recording medium are non-transient tangible recording media.

A process executed by the vehicle-surrounding-situation recognizing unit 12 corresponds to a vehicle-surrounding-situation recognizing step in a vehicle control method of the present invention. A process executed by the vehicle-interior-situation recognizing unit 13 corresponds to a vehicle-interior-situation recognizing step in the vehicle control method of the present invention. A process executed by the power door control unit 14 corresponds to a power door control step of the present invention.

As shown in FIG. 1, when the user Ud who carries the portable key 200 approaches the vehicle 1, the key authentication unit 11 communicates with the portable key 200 via the communication unit 120, and receives an ID code from the portable key 200. Then, when the received ID code equals the authentication ID code 82 stored in the memory 80, the key authentication unit 11 permits the user Ud to use the vehicle 1. As a result, the user Ud can operate the vehicle 1.

As shown in FIG. 1, the portable key 200 includes: a lock-unlock button 201 for instructing lock and unlock of the vehicle 1; a right power hinge door button 202 for instructing opening and closing of the right power hinge door 2; a left power hinge door button 203 for instructing opening and closing of the left power hinge door 3; a right power slide door button 204 for instructing opening and closing of the right power slide door 4; a left power slide door button 205 for instructing opening and closing of the left power slide door 5; and a power tail gate button 206 for instructing opening and closing of the power tailgate 6.

The user Ud can operate the lock-unlock button 201 of the portable key 200 to unlock the respective doors 2 to 6 of the vehicle 1 and get on the vehicle 1. In addition, the user Ud can operate the buttons 202 to 206 of the portable key 200 to instruct the vehicle 1 to open and close the power door. The user Ud who carries the portable key 200 and gets on the vehicle 1 turns on the power switch 72 to start the vehicle 1 and starts using the vehicle 1.

The vehicle-surrounding-situation recognizing unit 12 recognizes a surrounding situation of the vehicle 1 based on the images taken by the front camera 30, the right side camera 40, the left side camera 50, and the rear camera 60. In particular, the vehicle-surrounding-situation recognizing unit 12 recognizes the subsequent actions of the user who has got off the vehicle 1 based on the images taken by the front camera 30, the right side camera 40, the left side camera 50, and the rear camera 60.

Figure 3:
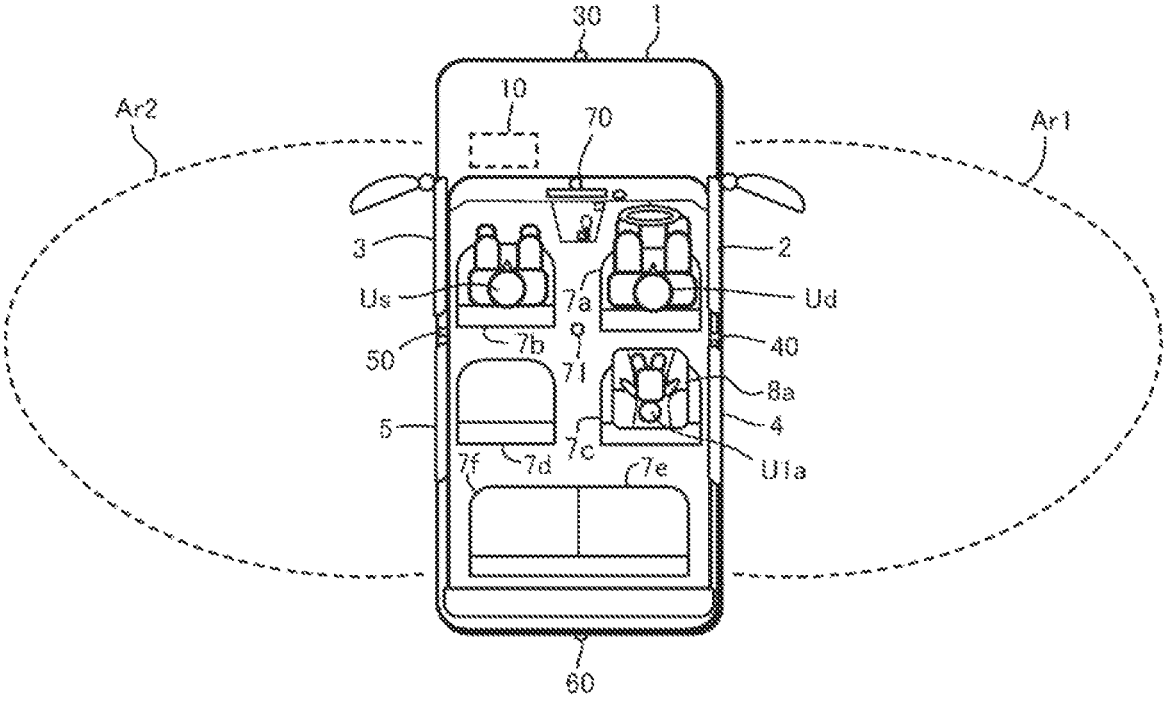
FIG. 3 is an explanatory diagram of a photographing range around the vehicle by a camera outside the vehicle.

Here, FIG. 3 shows an aspect of photographing the surroundings of the vehicle 1 by the right side camera 40 and the left side camera 50. In FIG. 3, Ar1 is the photographing range of the right side camera 40, and Ar2 is the photographing range of the left side camera 50. The vehicle-surrounding-situation recognizing unit 12 recognizes the user who has got off from the right power hinge door 2 or the right power slide door 4 from the image taken by the right side camera 40, and recognizes the subsequent actions. In addition, the vehicle-surrounding-situation recognizing unit 12 recognizes the user who has got off from the left power hinge door 3 or the left power slide door 5 from the image taken by the left side camera 50, and recognizes the subsequent actions.

The vehicle-interior-situation recognizing unit 13 recognizes the vehicle 1 interior situation from the images taken by the front-seat camera 70 and the rear-seat camera 71. In particular, the vehicle-interior-situation recognizing unit 13 recognizes the situation of the user in the vehicle 1. Note that the vehicle-interior-situation recognizing unit 13 may recognize the vehicle interior situation using the detection signals of the seatbelt switches 74*a* to 74*f*, the detection signals of the door switches 75*a* to 75*e*, and the like, as well as the images taken by the front-seat camera 70 and the rear-seat camera 71.

3. Power-Door-Opening Control

With reference to FIGS. 7 to 12, according to the flowcharts shown in FIGS. 4 to 6, processes of power-door-opening control executed by the power door control unit 14 and processes executed in connection with the power door control is described below. In the following, the user who is in the vehicle 1 using the child safety seat is referred to as a first user, the user who has got off the vehicle 1 is referred to as a second user, the user who is in a vicinity of the first user in the vehicle interior is referred to as a third user, and the user who picks up the first user in the vehicle interior is referred to as a fourth user.

Figure 4:
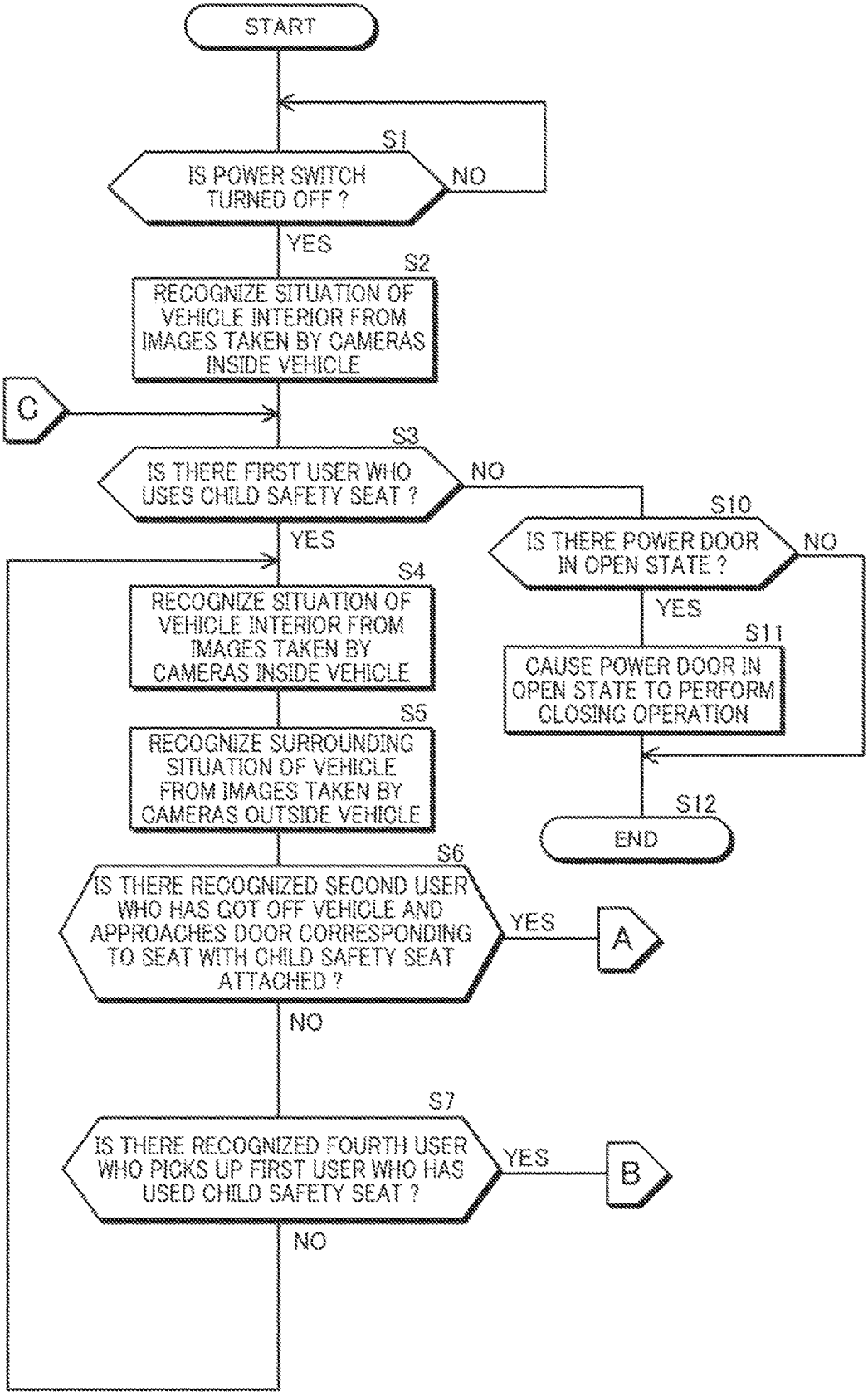
FIG. 4 is a first flowchart of power-door-opening control.

When the power door control unit 14 recognizes an off operation of the power switch 72 in step S1 of FIG. 4, it advances the process to step S2. In step S2, the vehicle-interior-situation recognizing unit 13 recognizes the vehicle 1 interior situation from the images taken by the cameras inside the vehicle (the front-seat camera 70, and the rear-seat camera 71).

In following step S3, the power door control unit 14 determines whether the first user using the child safety seat is recognized by the vehicle-interior-situation recognizing unit 13. Then, when the first user is recognized, the power door control unit 14 advances the process to step S4. On the other hand, when the first user using the child safety seat is not recognized, the power door control unit 14 advances the process to step S10, and in this case, the power-door-opening control is not executed.

In step S10, the power door control unit 14 determines whether there is a power door that is in an open state based on the detection signals of the door switches 75*a* to 75*e*. Then, when there is a power door that is in the open state, the power door control unit 14 advances the process to step S11 to cause the power door that is in the open state to perform a closing operation. On the other hand, when there is no power door that is in the open state, the power door control unit 14 advances the process to step S12.

In step S4, the vehicle-interior-situation recognizing unit 13 recognizes the vehicle 1 interior situation from the images taken by the cameras inside the vehicle. In next step S5, the vehicle-interior-situation recognizing unit 13 recognizes the left and right surrounding situations of the vehicle 1 from the images taken by the cameras outside the vehicle (the front camera 30, the right side camera 40, the left side camera 50, and the rear camera 60)

In next step S6, the power door control unit 14 determines whether the vehicle-surrounding-situation recognizing unit 12 recognizes the second user who has got off the vehicle 1 and approaches the door corresponding to the seat with the child safety seat attached. Then, when the second user is recognized, the power door control unit 14 advances the process to step S20 of FIG. 5, and when the second user is not recognized, it advances the process to step S7.

In step S7, the power door control unit 14 determines whether the vehicle-interior-situation recognizing unit 13 recognizes the fourth user who picks up the first user who uses the child safety seat. Then, when the fourth user is recognized, the power door control unit 14 advances the process to step S30 of FIG. 6, and when the fourth user is not recognized, it advances the process to step S4.

Figure 5:
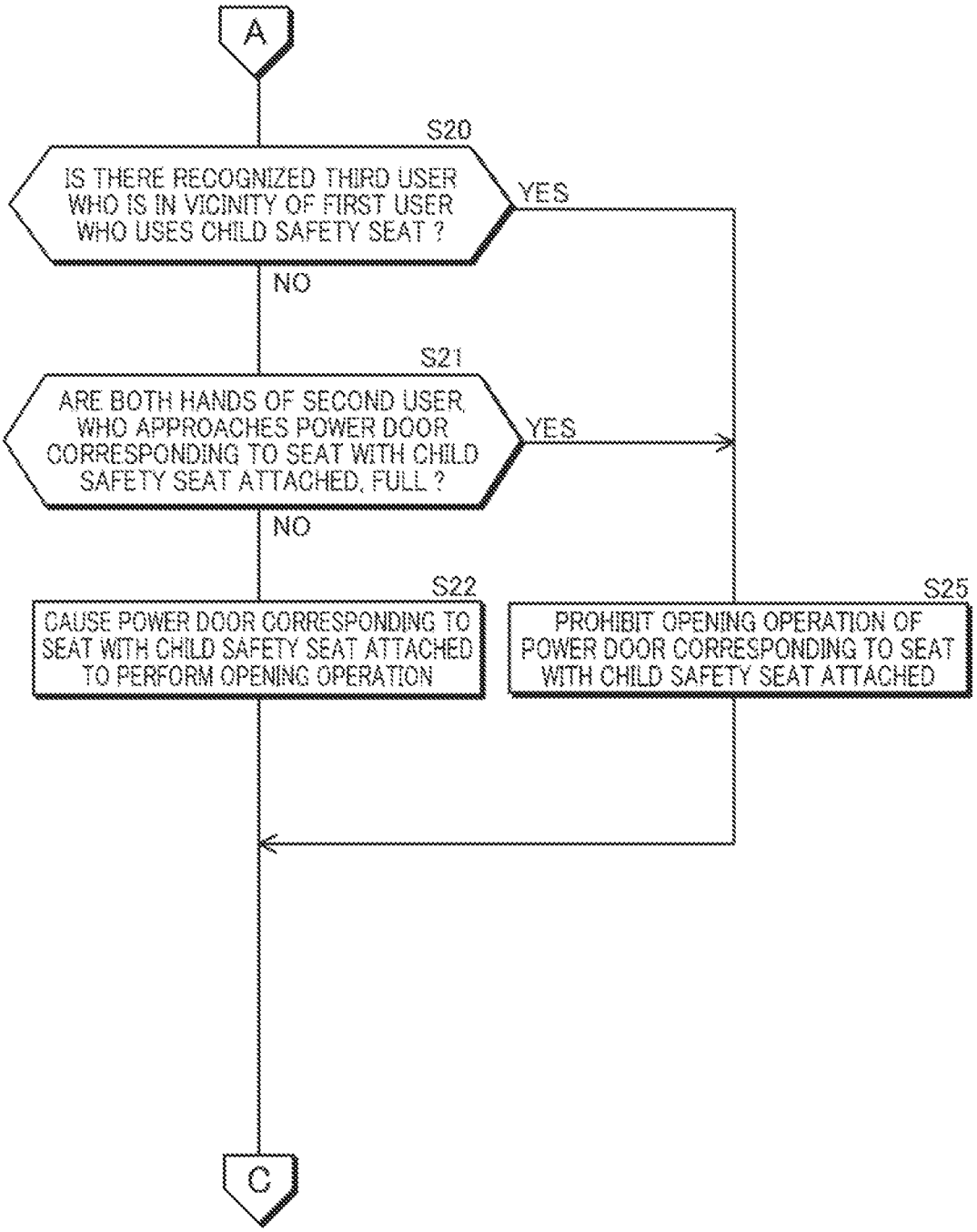
FIG. 5 is a second flowchart of the power-door-opening control.

Steps S20 to S22 and step S25 of FIG. 5 are a determination of whether to execute first power-door-opening control and processes of the first power-door-opening control. In step S20, the power door control unit 14 determines whether the vehicle-interior-situation recognizing unit 13 recognizes the third user in a vicinity of the first user who uses the child safety seat.

Then, the power door control unit 14 advances the process to step S25 when the third user is recognized, and it advances the process to step S21 when the third user is not recognized. In step S21, the power door control unit 14 determines whether the vehicle-surrounding-situation recognizing unit 12 recognizes that both hands of the second user, who has approached the power door that corresponds to the seat with the child safety seat attached, are full.

Then, when both hands of the second user are full, the power door control unit 14 advances the process to step S25, and when both hands of the second user are not full, it advances the process to step S22. In step S22, the power door control unit 14 executes the first power-door-opening control that causes the power door corresponding to the seat with the child safety seat attached to perform the opening operation, and it advances the process to step S3 of FIG. 4.

Figure 7:
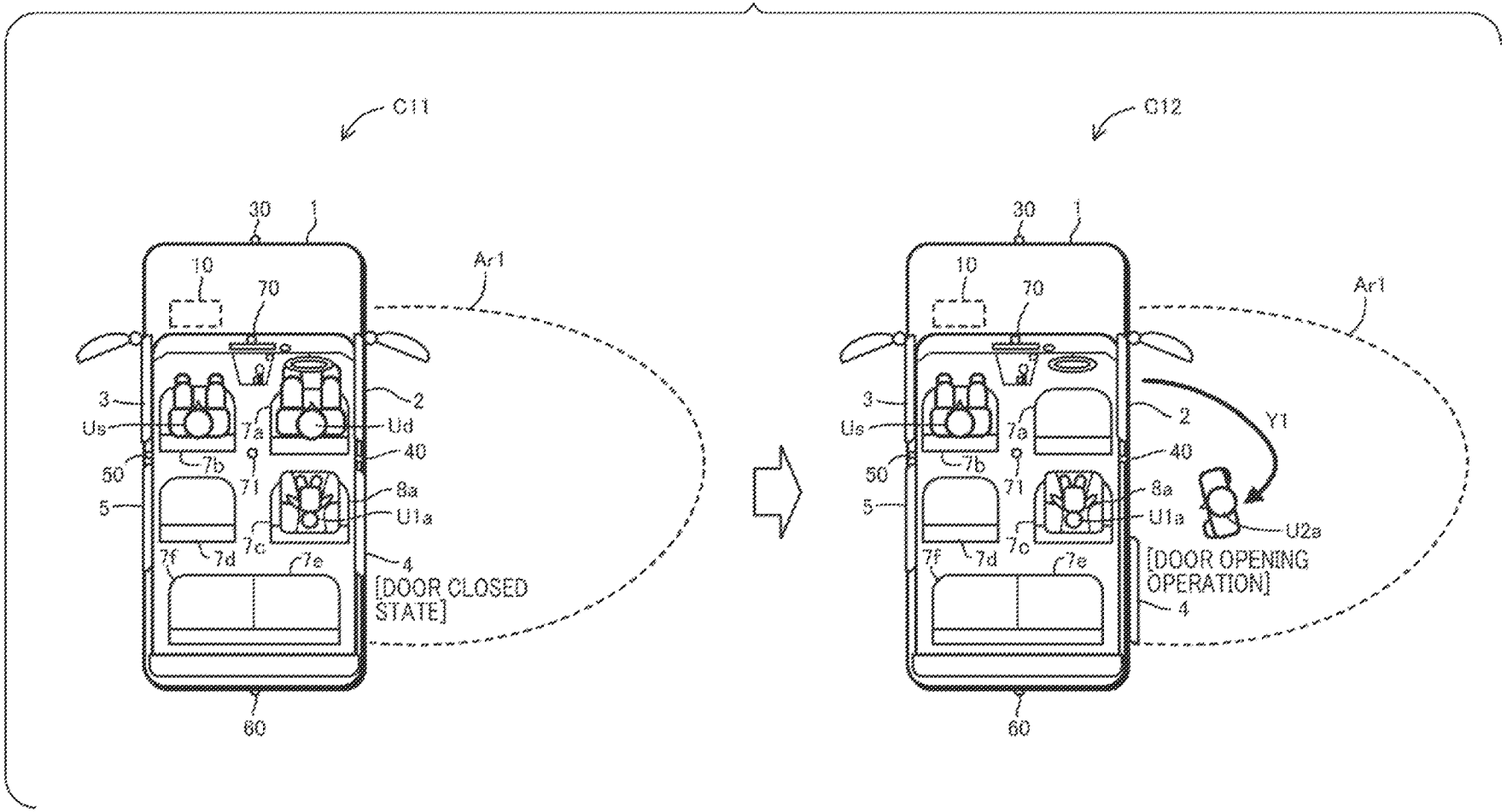
FIG. 7 is an explanatory diagram of first power-door-opening control.

Here, an example of situations in which the process of step S22 causes the power door to perform the opening operation is described with reference to FIG. 7. C11 in FIG. 7 shows a situation in which the user Ud is on the driver's seat 7*a*, the user Us is on the front passenger seat 7*b*, and the first user U1*a* is on the child safety seat 8*a* attached to the second row right seat 7*c*, of the vehicle 1. In the situation of C11, the user Ud gets off the vehicle 1 and becomes the second user. When the user Ud (user Ud→second user U2*a*) approaches the right power slide door 4 corresponding to the seat 7*c* to which the child safety seat 8*a* is attached, as shown by an arrow Y1, the first power-door-opening control is executed to cause the right power slide door 4 to perform the opening operation. As a result, the second user U2*a* can get on the vehicle 1 through an opening of the right power slide door 4, which automatically has performed the opening operation, without an operation for causing the right power slide door 4 to perform the opening operation, to assist the first user U1*a* to get off.

Figure 8:
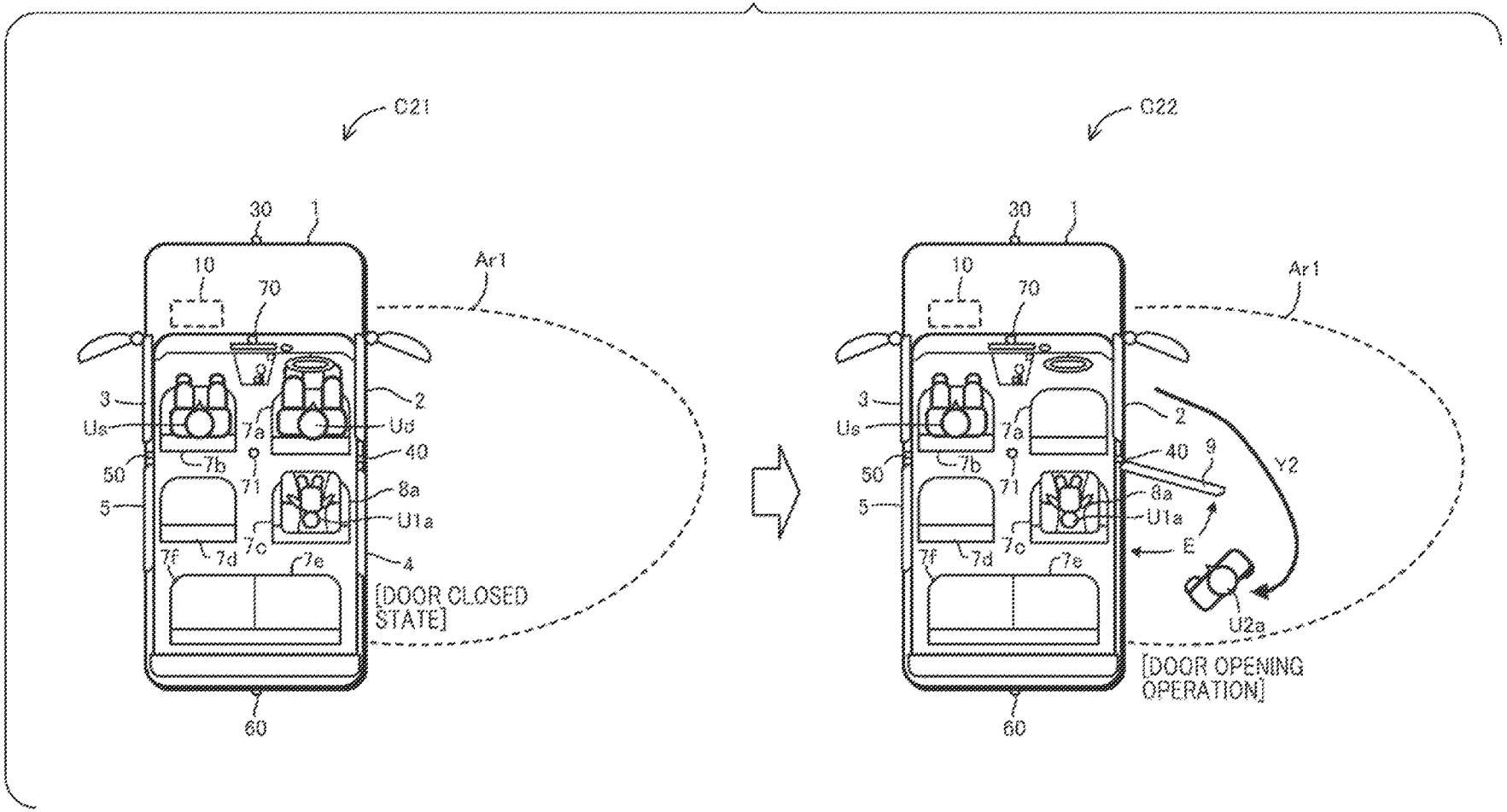
FIG. 8 is an explanatory diagram of the first power-door-opening control corresponding to a power hinge door.

In addition, FIG. 8 shows an execution example of the power door opening operation when the door corresponding to the second row seats and the third row seats of the vehicle 1 is the rear seat right power hinge door 9. As in the case of FIG. 7, the user Ud gets off the vehicle 1 in a state of C21 and becomes the second user. When the user Ud (user Ud→second user U2*a*) approaches the rear seat right power hinge door 9, the power door control unit 14 causes the rear seat right power hinge door 9 to perform the opening operation as shown in C22.

As shown in C22, the power door control unit 14 causes the rear seat right power hinge door 9 to perform the opening operation at a timing when the second user U2*a* moves to the rear of the rear seat right power hinge door 9 so that the second user U2*a* is located at a position facing a range E. The range E is a range between the inner surface of the rear seat right power hinge door 9 and an opening of the rear seat right power hinge door 9 when the rear seat right power hinge door 9 performs the opening operation. As a result, the second user U2*a* can get on the vehicle 1 through the opening of the rear seat right power hinge door 9.

Here, for example, if the rear seat right power hinge door 9 is caused to perform the opening operation when the second user U2*a* gets off from the rear seat right power hinge door 2 and is still located in the vicinity of the rear seat right power hinge door 2, the rear seat right power hinge door blocks a path of the second user U2*a*. As a result, the second user U2*a* has to greatly go around the rear seat right power hinge door 9 to head toward the opening of the rear seat right power hinge door 9. Causing the rear seat right power hinge door 9 to perform the opening operation at the above timing enables avoiding such a situation.

Figure 9:
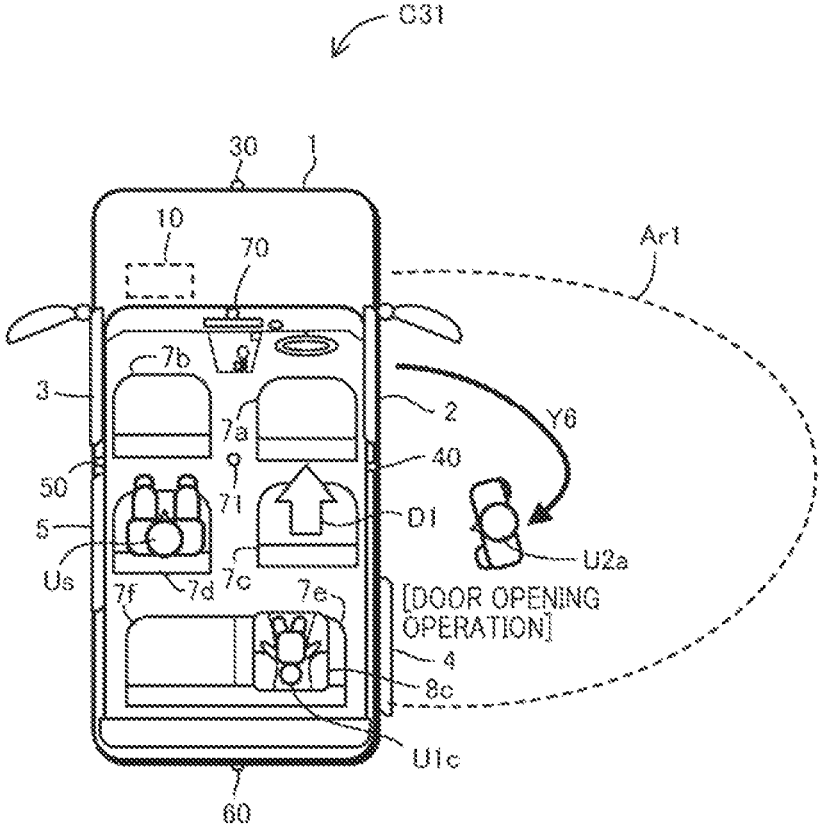
FIG. 9 is an explanatory diagram of a process of sliding a second row seat in the first power-door-opening control.

In addition, C31 in FIG. 9 shows a situation in which the first user U1*c* uses the child safety seat 8*c* attached to the third row right seat 7*e*, and the second user U2*a* approaches the right power slide door 4 corresponding to the third row right seat 7*e*, as shown by an arrow Y6. The second row right seat 7*c* is provided with an actuator (not shown) that causes the second row right seat 7*c* to perform a backward and forward slide operation. In this case, the power door control unit 14 causes the right power slide door 4 to perform the opening operation by the first power-door-opening control, and at that time, the power door control unit 14 may cause the second row right seat 7*c* to perform a forward slide operation. Causing the second row right seat 7*c* to perform the forward slide operation can facilitate getting on and off the third row right seat 7*e*.

Figure 10:
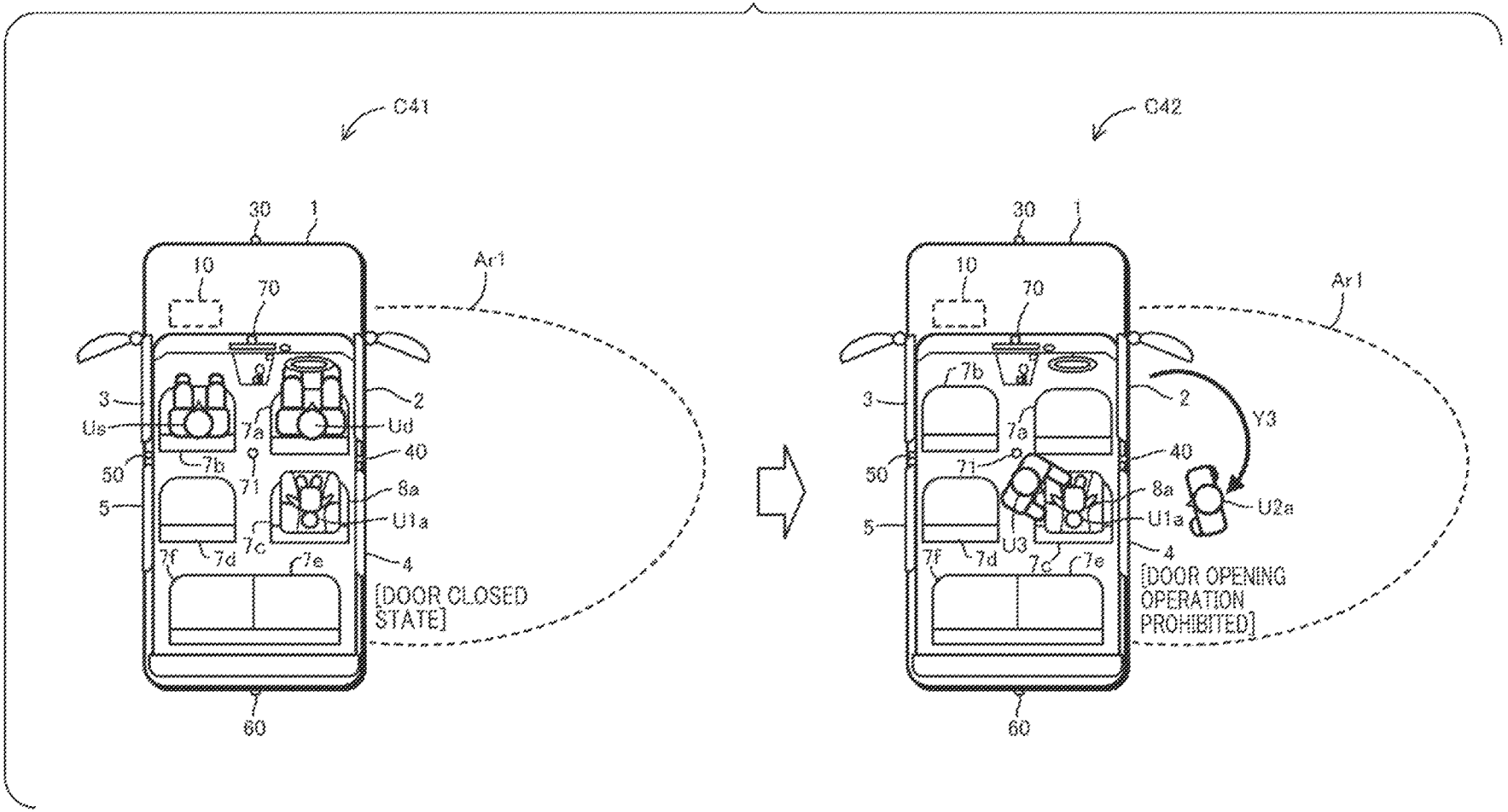
FIG. 10 is an explanatory diagram of a first situation in which the first power-door-opening control is prohibited.

Next, with reference to FIG. 10, an example of a situation in which a determination in step S20 of FIG. 5 prohibits the first power-door-opening control is described below. From the situation of C41 in FIG. 10, as shown in C42, when the user Us moves backward and approaches the child safety seat 8*a* to become the third user (user Us→third user U3) and takes care of the first user U1*a*, the vehicle-interior-situation recognizing unit 13 recognizes that the third user U3 is in a vicinity of the first user U1*a*.

As a result, when the second user U2*a* who has got off the vehicle 1 approaches the right power slide door 4, the power door control unit 14 advances the process from step S20 to step S25 to prohibit the opening operation of the right power slide door 4 by the first power-door-opening control. This can prevent the first user U1*a* and the third user U3 from feeling cold due to the inflow of outside air when the right power slide door 4 is opened.

Here, an example of another situation in which the third user U3 is recognized to be in a vicinity of the first user U1*a* by the vehicle-interior-situation recognizing unit 13 is a situation in which it is recognized from the images taken by the cameras inside the vehicle that the third user U3 sits on a seat in the same row as the first user U1*a*, and the line-of-sight of the third user U3 faces the first user U1*a*. An example of still another situation is a situation in which it is recognized that the third user U3 has moved toward the first user U1*a*, from the images taken by the cameras inside the vehicle.

Figure 11:
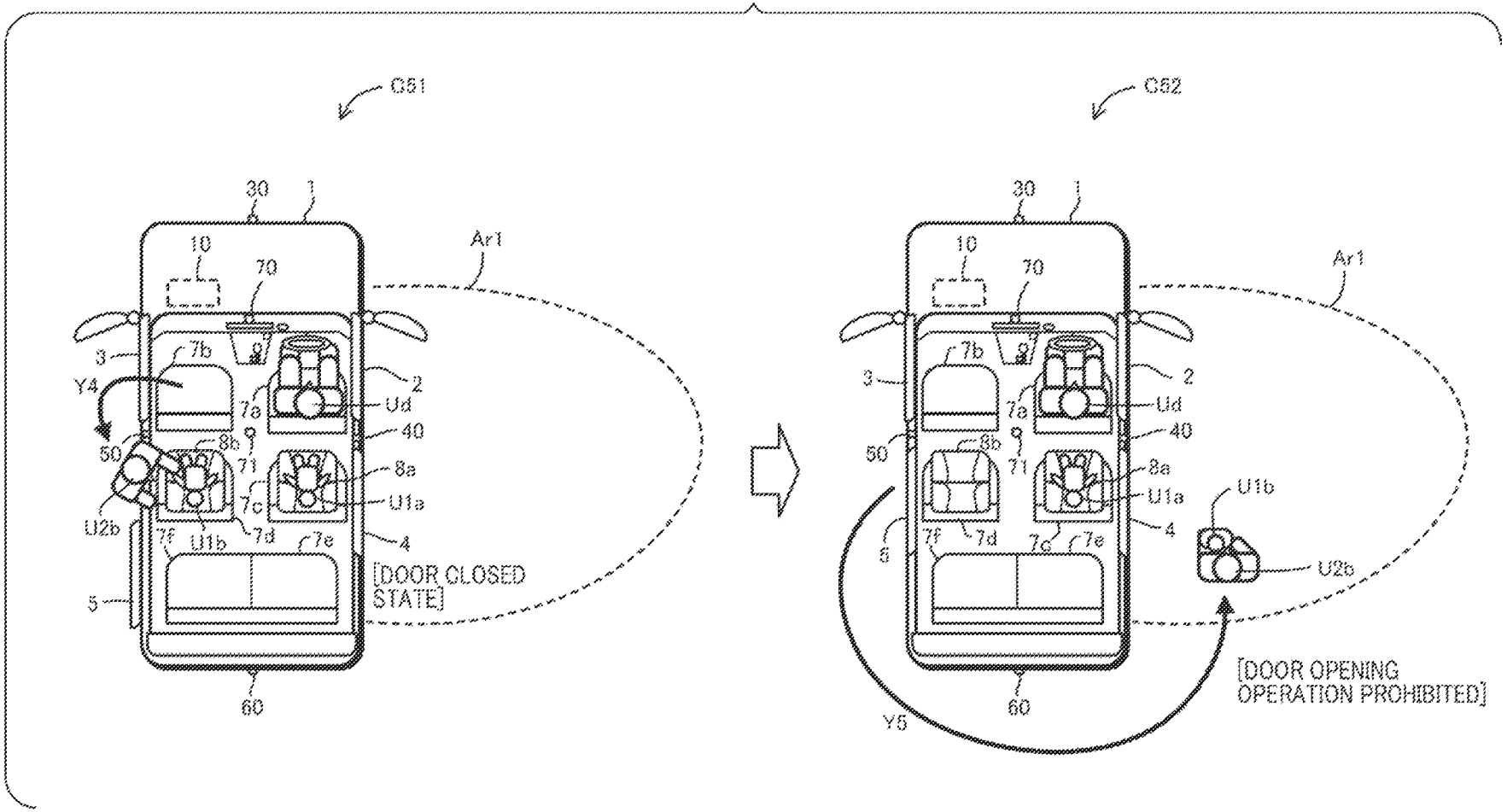
FIG. 11 is an explanatory diagram of a second situation in which the first power-door-opening control is prohibited.

Next, with reference to FIG. 11, a situation is described below in which a determination in step S21 of FIG. 5 prohibits the first power-door-opening control. In C51 of FIG. 11, a first user U1*a* uses the child safety seat 8*a* attached to the second row right seat 7*c*, and a first user U1*b* uses a child safety seat 8*b* attached to the second row left seat 7*d*. Then, the user Us (user Us→second user U2*b*) who has got off from the front passenger seat 7*b* and became the second user approaches the left power slide door 5, as shown by an arrow Y4, the left power slide door 5 performs the opening operation by the process of step S22, and the second user U2*b* removes the first user U1*b* from the child safety seat 8*b* and picks up the first user U1*b*.

Then, as shown in C52, the second user U2*b* holding the first user U1*b* passes behind the vehicle 1 and approaches the right power slide door 4 as shown by an arrow Y5. At this time, since the second user U2*b* holds the first user U1*b*, both hands of the second user U2*b* are full. Therefore, the vehicle-surrounding-situation recognizing unit 12 recognizes that both hands of the second user U2*b* are full, and the power door control unit 14 advances the process from step S21 to step S25 in FIG. 5 to prohibit the opening operation of the right power slide door 4 by the first power-door-opening control.

This prevents the right power slide door 4 from performing the opening operation in the situation in which both hands of the second user U2*b* are full, and the second user U2*b* cannot assist the first user U1*c* who uses the child safety seat 8*a* of the second row right seat 7*c*.

Figure 6:
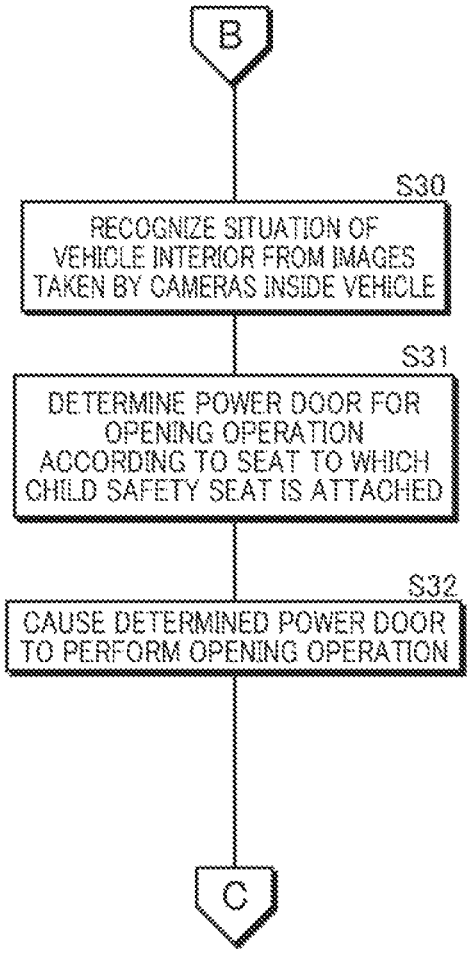
FIG. 6 is a third flowchart of the power-door-opening control.

Next, steps S30 to S32 of FIG. 6 are processes of second power-door-opening control. As described above, the second power-door-opening control is executed when the fourth user who picks up the first user who uses the child safety seat is recognized in step S7 of FIG. 4.

In step S30, the vehicle-interior-situation recognizing unit 13 recognizes the vehicle 1 interior situation from the images taken by the cameras inside the vehicle. In next step S31, the power door control unit 14 determines the power door to be caused to perform the opening operation, depending on the seat to which the child safety seat used by the first user is attached, which is recognized by the vehicle-interior-situation recognizing unit 13. In following step S32, the power door control unit 14 causes the determined power door to perform the opening operation, and advances the process to step S3 of FIG. 4.

Figure 12:
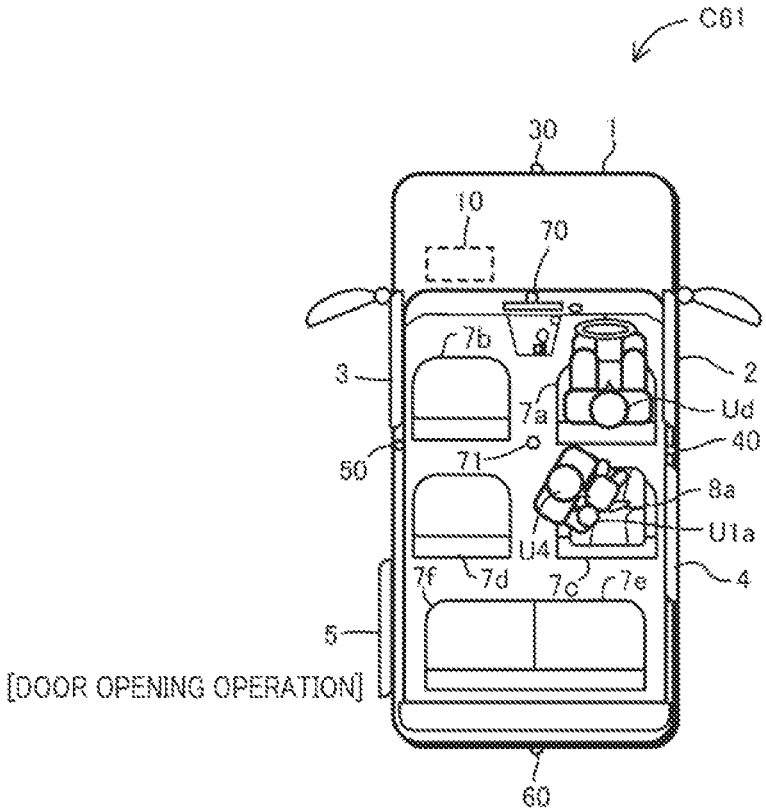
FIG. 12 is an explanatory diagram of second power-door-opening control.

Here, an example of a situation in which the second power-door-opening control is executed is described below with reference to FIGS. 12 and 13. C61 in FIG. 12 shows a situation in which the child safety seat 8*a* is attached to the second row right seat 7*c*, and the fourth user U4 picks up the first user U1*a* using the child safety seat 8*a*. Note that, when the fourth user U4 is the user Us sitting on the front passenger seat 7*b* as shown in FIG. 10, the user Us becomes the third user U3 when approaching the first user U1*a*, and becomes the fourth user U4 when picking up the first user U1*a*.

In this situation, for the second row right seat 7*c* located at one end of the second row, the power door control unit 14 determines the left power slide door 5, which corresponds to the second row left seat 7*d* and is located at the other end of the second row, to be the power door to be caused to perform the opening operation. Then, the power door control unit 14 causes the left power slide door 5 to perform the opening operation. As a result, instead of the right power slide door 4, which is difficult to use because the child safety seat 8*a* is in the way, the fourth user U4 who picks up the first user U1*a* can easily get off from an opening of the left power slide door 5 on the opposite side.

Figure 13:
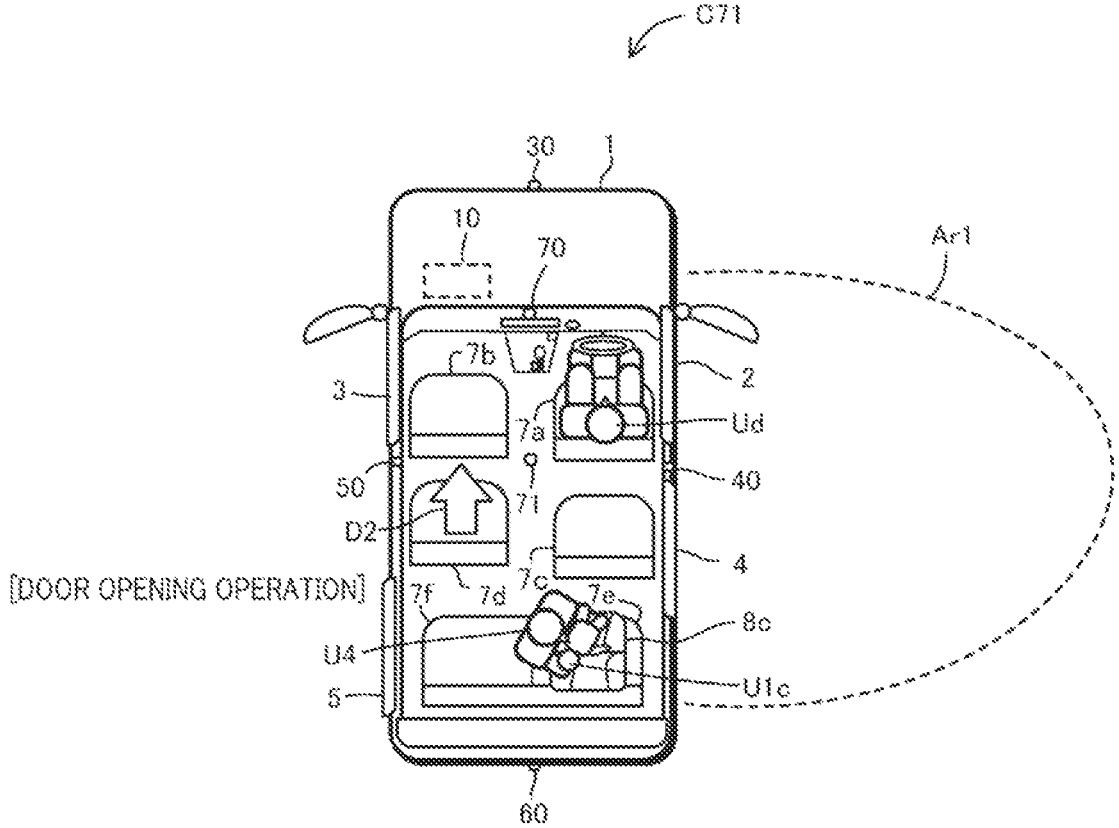
FIG. 13 is an explanatory diagram of a process of sliding a second row seat in the second power-door-opening control.

In addition, C71 in FIG. 13 shows a situation in which the child safety seat 8*c* is attached to the third row right seat 7*e*, and the fourth user U4 picks up the first user U1*c* using the child safety seat 8*c*. In this situation, for the third row right seat 7*e* located at one end of the third row, the power door control unit 14 determines the left power slide door 5, which corresponds to the third row left seat 7*f* and is located at the other end of the third row, to be the power door to be caused to perform the opening operation.

Then, the power door control unit 14 causes the left power slide door 5 to perform the opening operation. As a result, instead of the right power slide door 4, which is difficult to use because the child safety seat 8*c* is in the way, the fourth user U4 who picks up the first user U1*c* can easily get off from the opening of the left power slide door 5 on the opposite side.

In addition, the second row left seat 7*d* is provided with an actuator (not shown) that causes the second row left seat 7*d* to perform the forward and backward slide operation. In this case, the power door control unit 14 may cause the right power slide door 4 to perform the opening operation and cause the second row left seat 7*d* to perform the forward slide operation. Causing the second row left seat 7*c* to perform the forward slide operation enables facilitating the movement from the third row right seat 7*e* to the opening of the left power slide door 5.

4. Other Embodiments

In the above embodiment, the power door control unit 14 executes the first power-door-opening control and the second power-door-opening control when the first user, who uses an infant safety seat such as a child safety seat, is recognized. Another embodiment may be such that the use of the child safety seats is not determined and a power door corresponding to a seat used by a user is caused to perform the opening operation when it is recognized that another user who has got off the vehicle approaches the power door. This can facilitate the assistance for getting off when a user who needs assistance when getting off, such as an elderly person, is on the vehicle.

In the above embodiment, in step S20 of FIG. 5, when there is the third user in a vicinity of the first user who is using the child safety seat, the process of prohibiting the first power-door-opening control is performed, but this process may be omitted.

In the above embodiment, in step S21 of FIG. 5, when both hands of the second user, who has approached the power door corresponding to the seat to which the child safety seat is attached, are full, the process of prohibiting the first power-door-opening control is performed, but this process may be omitted.

In the above embodiment, the power door control unit 14 executes the first power-door-opening control and the second power-door-opening control, but it may execute only the first power-door-opening control.

Figure 2:
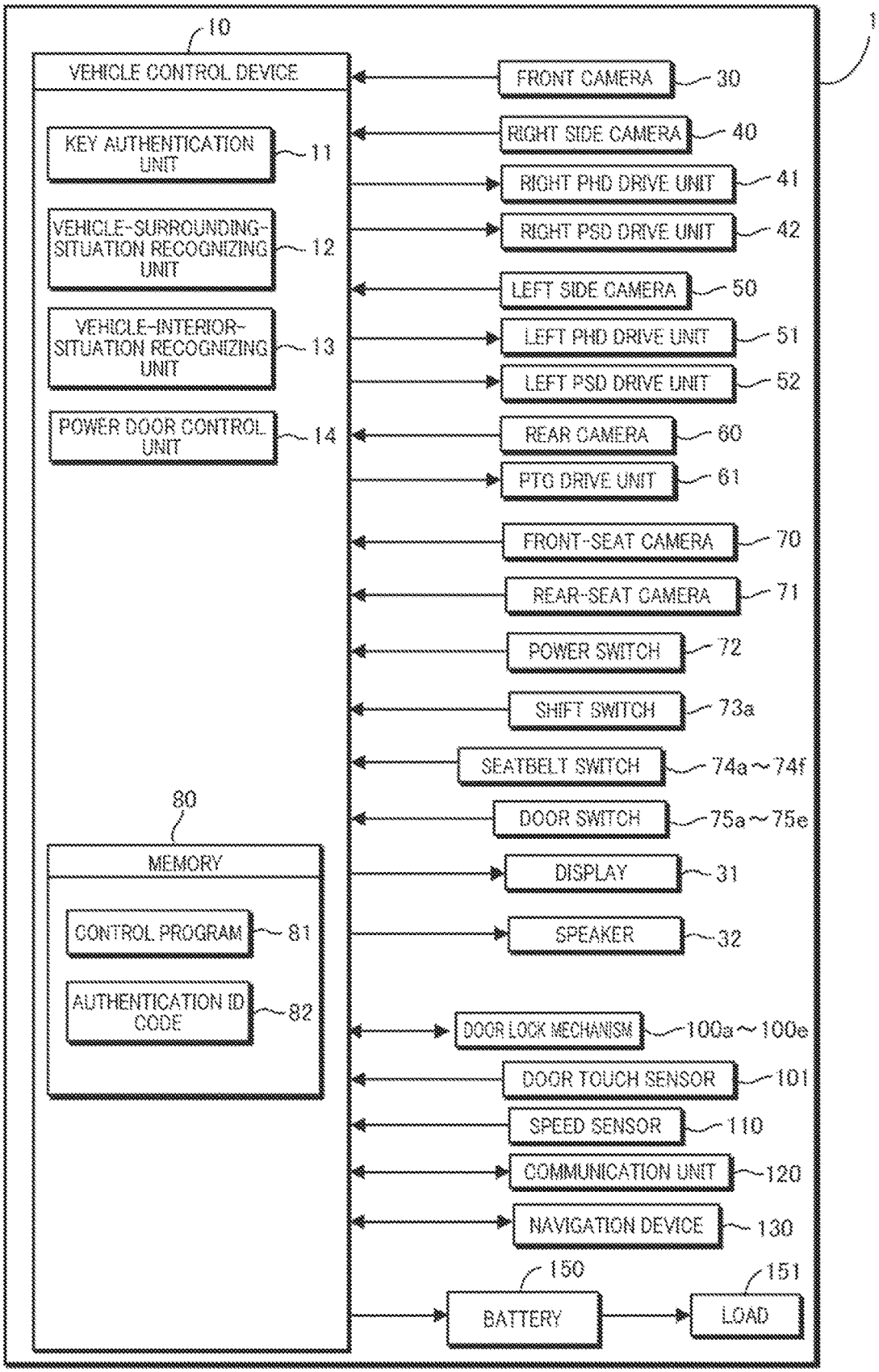
FIG. 2 is a configuration diagram of the vehicle control device.

Note that, FIGS. 1 and 2 are schematic diagrams showing the configurations of the vehicle 1 and the vehicle control device 10 classified according to what is mainly in the process in order to facilitate understanding of the invention of the application, and the configurations of the vehicle 1 and the vehicle control device 10 may be configured by other classification. In addition, the process of each component may be executed by one hardware unit, or may be executed by a plurality of hardware units. In addition, the process by each component shown in FIGS. 4 to 6 may be executed by one program or may be executed by a plurality of programs.

5. Configurations Supported by the Above Embodiments

The above embodiments are specific examples of the following configurations.

Item 1

A vehicle control device that controls an opening operation of a power door provided in a vehicle, the vehicle control device including: a vehicle-surrounding-situation recognizing unit that recognizes a surrounding situation of the vehicle; a vehicle-interior-situation recognizing unit that recognizes a situation of an interior of the vehicle; and a power door control unit that executes first power-door-opening control, when the power door is in a closed state and the vehicle-interior-situation recognizing unit recognizes a first user who uses a predetermined seat provided in the vehicle, and when the vehicle-surrounding-situation recognizing unit recognizes that a second user approaches the power door corresponding to the predetermined seat, the first power-door-opening control causing the power door to perform the opening operation, the second user being a user who has got off the vehicle.

According to the vehicle control device of item 1, when the predetermined seat of the vehicle is used by a first user who needs assistance when getting off, such as an infant or an elderly person, and when the second user who has got off the vehicle approaches the power door corresponding to the predetermined seat, the power door control unit executes the first power-door-opening control to cause the power door to perform the opening operation. The second user can get on the vehicle from the power door that has finished the opening operation to assist the first user in getting off the vehicle without performing any operation for causing the power door to perform the opening operation. As described above, the vehicle control device of item 1 can appropriately cause the power door of the vehicle to perform the opening operation in response to the usage status of the vehicle in which a user who needs assistance when getting off is in the vehicle.

Item 2

The vehicle control device according to item 1, wherein the power door control unit executes the first power-door-opening control when the vehicle-interior-situation recognizing unit recognizes that the first user uses an infant safety seat, the infant safety seat being attached to the predetermined seat.

According to the vehicle control device of item 2, the second user can easily assist the first user (infant) who uses the infant safety seat without an operation for opening the power door.

Item 3

The vehicle control device according to item 2, wherein the power door control unit prohibits the first power-door-opening control when the vehicle-interior-situation recognizing unit recognizes a third user who is in a vicinity of the first user in the vehicle.

The vehicle control device of item 3 can prevent the power door from being inadvertently opened so that the first user (infant) is exposed to the outside air when the third user assists the infant in the vehicle interior.

Item 4

The vehicle control device according to item 2 or 3, wherein: the predetermined seat is a seat at one end of a predetermined row of the vehicle; and the power door control unit executes second power-door-opening control when the vehicle-interior-situation recognizing unit recognizes that a fourth user has picked up the first user, the second power-door-opening control causing the power door corresponding to a seat at another end of the predetermined row to perform the opening operation.

The vehicle control device of item 4 can cause the power slide door to perform the opening operation at a timing when it is presumed that the fourth user holds the first user (infant) and is ready to get off.

Item 5

The vehicle control device according to any one of items 1 to 4, wherein the power door control unit prohibits the first power-door-opening control when the vehicle-surrounding-situation recognizing unit recognizes that both hands of the second user are full.

The vehicle control device of item 5 can prevent the power door from being opened unnecessarily when both hands of the second user are full and the second user cannot assist the first user.

Item 6

The vehicle control device according to any one of items 1 to 5, wherein: the power door is a power hinge door; and the power door control unit executes the first power-door-opening control when the vehicle-surrounding-situation recognizing unit recognizes that: the second user is outside a movable range of the power hinge door; and the second user is located at a position where the second user faces a range, the range being between an opening of the power hinge door and an inner surface of the power hinge door when the power hinge door performs the opening operation.

The vehicle control device of item 6 can cause the power hinge door to perform the opening operation when the second user is located at a position where the second user can proceed to the opening of the power hinge door without being blocked by the power hinge door when the power hinge door performs the opening operation.

Item 7

The vehicle control device according to any one of items 1 to 5, wherein: the power door is a power slide door; and the power door control unit executes the first power-door-opening control when the vehicle-surrounding-situation recognizing unit recognizes that the second user is located at a position facing the power door.

The vehicle control device according to item 7 can cause the power slide door to perform the opening operation when the second user approaches a position facing the power slide door.

Item 8

A vehicle control method executed by a computer to control an opening operation of a power door provided in a vehicle, the method including: a vehicle-surrounding-situation recognizing step that recognizes a surrounding situation of the vehicle; a vehicle-interior-situation recognizing step that recognizes a situation of an interior of the vehicle; and a power door control step that executes first power-door-opening control, when the power door is in a closed state and the vehicle-interior-situation recognizing step recognizes a first user who uses a predetermined seat provided in the vehicle, and when the vehicle-surrounding-situation recognizing step recognizes that a second user approaches the power door corresponding to the predetermined seat, the first power-door-opening control causing the power door to perform the opening operation, the second user being a user who has got off the vehicle.

Executing the vehicle control method of item 8 by a computer enables obtaining the same function effect as the vehicle control device of item 1.

Item 9

A non-transient recording medium on which a vehicle control program is recorded, the program causing a computer, to control an opening operation of a power door provided in a vehicle, to function as: a vehicle-surrounding-situation recognizing unit that recognizes a surrounding situation of the vehicle; a vehicle-interior-situation recognizing unit that recognizes a situation of an interior of the vehicle; and a power door control unit that executes first power-door-opening control, when the power door is in a closed state and the vehicle-interior-situation recognizing unit recognizes a first user who uses a predetermined seat provided in the vehicle, and when the vehicle-surrounding-situation recognizing unit recognizes that a second user approaches the power door corresponding to the predetermined seat, the first power-door-opening control causing the power door to perform the opening operation, the second user being a user who has got off the vehicle.

Causing a computer to execute the vehicle control program of item 9 can realize the configuration of the vehicle control device of item 1.

REFERENCE SIGNS LIST

1 vehicle
2 right power hinge door
3 left power hinge door
4 right power slide door
5 left power slide door
6 power tailgate
8*a*-8*c* child safety seat (infant safety seat)
10 vehicle control device
11 key authentication unit
12 vehicle-surrounding-situation recognizing unit
13 vehicle-interior-situation recognizing unit
14 power door control unit
40 right side camera
50 left side camera
70 front-seat camera
71 rear-seat camera
80 memory
81 control program
82 authentication ID code
U1*a*-U1*c* first user
U2*a*, U2*b* second user
U3 third user
U4 fourth user

What is claimed is:

1. A vehicle control device that controls an opening operation of a power door provided in a vehicle, the vehicle control device comprising a central processing unit (CPU) that includes:

a vehicle-surrounding-situation recognizing unit that recognizes a surrounding situation of the vehicle;

a vehicle-interior-situation recognizing unit that recognizes a situation of an interior of the vehicle; and a power door control unit, wherein upon the power door being in a closed state and the vehicle-interior-situation recognizing unit recognizing a first user using a predetermined seat provided in the vehicle, the power door control unit determines whether the vehicle-surrounding-situation recognizing unit recognizes that a second user approaches the power door corresponding to the predetermined seat, and upon the vehicle-surrounding-situation recognizing unit recognizing that the second user approaches the power door corresponding to the predetermined seat, the power door control unit executes first power-door-opening control, the first power-door-opening control causing the power door to perform the opening operation, the second user being a user having gotten off the vehicle.

2. The vehicle control device according to claim 1, wherein the power door control unit executes the first power-door-opening control upon the vehicle-interior-situation recognizing unit recognizing that the first user uses an infant safety seat, the infant safety seat being attached to the predetermined seat.

3. The vehicle control device according to claim 2, wherein the power door control unit prohibits the first power-door-opening control upon the vehicle-interior-situation recognizing unit recognizing a third user being in a vicinity of the first user in the vehicle.

4. The vehicle control device according to claim 2, wherein the predetermined seat is a seat at one end of a predetermined row of the vehicle, and the power door control unit executes second power-door-opening control upon the vehicle-interior-situation recognizing unit recognizing that a fourth user has picked up the first user, the second power-door-opening control causing the power door corresponding to a seat at another end of the predetermined row to perform the opening operation.

5. The vehicle control device according to claim 1, wherein the power door control unit prohibits the first power-door-opening control upon the vehicle-surrounding-situation recognizing unit recognizing that both hands of the second user are full.

6. The vehicle control device according to claim 1, wherein the power door is a power hinge door, and the power door control unit executes the first power-door-opening control upon the vehicle-surrounding-situation recognizing unit recognizing that: the second user is outside a movable range of the power hinge door; and the second user is located at a position where the second user faces a range, the range being between an opening of the power hinge door and an inner surface of the power hinge door upon the power hinge door performing the opening operation.

7. The vehicle control device according to claim 1, wherein the power door is a power slide door, and the power door control unit executes the first power-door-opening control upon the vehicle-surrounding-situation recognizing unit recognizing that the second user is located at a position facing the power door.

8. A vehicle control method executed by a computer to control an opening operation of a power door provided in a vehicle, the method comprising:

a vehicle-surrounding-situation recognizing step that recognizes a surrounding situation of the vehicle;

a vehicle-interior-situation recognizing step that recognizes a situation of an interior of the vehicle; and a power door control step, wherein upon the power door being in a closed state and the vehicle-interior-situation recognizing step recognizing a first user using a predetermined seat provided in the vehicle, the power door control step determines whether the vehicle-surrounding-situation recognizing step recognizes that a second user approaches the power door corresponding to the predetermined seat, and upon the vehicle-surrounding-situation recognizing step recognizing that the second user approaches the power door corresponding to the predetermined seat, the power door control step executes first power-door-opening control, the first power-door-opening control causing the power door to perform the opening operation, the second user being a user having gotten off the vehicle.

9. A non-transient recording medium recording a vehicle control program, the program causing a computer, to control an opening operation of a power door provided in a vehicle, to function as:

a vehicle-surrounding-situation recognizing unit that recognizes a surrounding situation of the vehicle;

a vehicle-interior-situation recognizing unit that recognizes a situation of an interior of the vehicle; and a power door control unit, wherein upon the power door being in a closed state and the vehicle-interior-situation recognizing unit recognizing a first user using a predetermined seat provided in the vehicle, the power door control unit determines whether the vehicle-surrounding-situation recognizing unit recognizes that a second user approaches the power door corresponding to the predetermined seat, and upon the vehicle-surrounding-situation recognizing unit recognizing that the second user approaches the power door corresponding to the predetermined seat, the power door control unit executes first power-door-opening control, the first power-door-opening control causing the power door to perform the opening operation, the second user being a user having gotten off the vehicle.

* * * * *